US009129793B2

(12) United States Patent
Ikeda et al.

(10) Patent No.: US 9,129,793 B2
(45) Date of Patent: Sep. 8, 2015

(54) HIGH PRESSURE DISCHARGE LAMP WITH AUXILIARY LAMP

(75) Inventors: Tomihiko Ikeda, Hyogo (JP); Hiroshi Takahashi, Hyogo (JP); Shinichi Ushijima, Hyogo (JP); Tetsuya Gouda, Hyogo (JP); Kei Shimada, Hyogo (JP)

(73) Assignee: PHOENIX ELECTRIC CO., LTD., Hyogo (JP)

( * ) Notice: Subject to any disclaimer, the term of this patent is extended or adjusted under 35 U.S.C. 154(b) by 852 days.

(21) Appl. No.: 13/397,346

(22) Filed: Feb. 15, 2012

(65) Prior Publication Data

US 2013/0099679 A1 Apr. 25, 2013

(30) Foreign Application Priority Data

Oct. 24, 2011 (JP) ..... 2011-233310

(51) Int. Cl.
*H05B 37/00* (2006.01)
*H01J 61/54* (2006.01)

(52) U.S. Cl.
CPC ..... *H01J 61/54* (2013.01); *H01J 61/547* (2013.01)

(58) Field of Classification Search
CPC ..... H05B 41/32–41/388
See application file for complete search history.

(56) References Cited

U.S. PATENT DOCUMENTS

2009/0206753 A1* 8/2009 Kakisaka ..... 313/634

FOREIGN PATENT DOCUMENTS

JP 2002-151006 5/2002

* cited by examiner

*Primary Examiner* — Sibin Chen
(74) *Attorney, Agent, or Firm* — Lucas & Mercanti, LLP

(57) ABSTRACT

A high pressure discharge lamp with auxiliary lamp comprises: a high pressure discharge lamp having an arc tube and at least one sealing portion, a pair of main electrodes, and a pair of feeders supplying power to the main electrodes; an auxiliary lamp having an airtight case, an inner electrode, and an outer electrode, wherein the inner electrode is arranged at a position so as to part the inner space to large and small spaces, the outer electrode is arranged at a position so as to face the large space, the auxiliary lamp as arranged as the large space faces the sealing portion.

5 Claims, 5 Drawing Sheets

HIGH PRESSURE DISCHARGE LAMP WITH AUXILIARY LAMP

BACKGROUND OF THE INVENTION

1. Field of the Invention

The present invention relates to a high pressure discharge lamp having an auxiliary lamp that emits ultraviolet rays for decreasing required voltage value for lighting-up. The auxiliary lamp enhances lighting-up performance of the discharge lamp.

2. Description of Related Art

High pressure discharge lamps are mainly used as light sources for optical devices, for example liquid-crystal projectors, exposure devices or the like. The high pressure discharge lamp comprises: an arc tube having a space where luminescent materials such as mercury, halide, products from halogen cycle, or the like are enclosed; and a pair of main electrodes placed oppositely each other inside the arc tube. An electrical discharge by an insulation breakdown between the main electrodes that high voltage for lighting-up is applied excites the luminescent materials. The excited luminescent materials emit light.

Recently, for reducing the size of point light sources and enhancing luminance efficiency of high pressure discharge lumps, an amount of the enclosed luminescent materials is increased and a volume of the space of the arc tube is decreased. Consequently, a pressure of the arc tube in operation is extremely high, for example approximately 200 atmospheres or higher. Furthermore, this kind of the optical devices is required to reduce the time not only for cold start but for hot start.

Particularly, the higher the pressure inside the arc tube is, the higher the required voltage for generating the electric discharge is. At the hot start, when inner temperature of the arc tube is high, it is required not only to apply high voltage but to wait until the temperature of the high pressure discharge lamp becomes relatively low. And high voltage, for example more than 10 kV, is required for the cold start.

But application of the high voltage in lighting-up of the high pressure discharge lamp causes a problem. For example, insulation breakdown at unintended position is generated and the insulation breakdown causes electrification. And noises generated by the application of the high pressure voltage causes malfunction of an electronic circuit provided for the optical device. The "insulation breakdown at unintended position" is, for example, insulation breakdown between two insulation cables or creeping discharge on a surface of a connector or a connecting terminal.

Technology for lighting-up the high pressure discharge lamp with lower voltage has been developed to solve these problems. For example, see Patent Document 1 (JP-A-2002-151006). A light source 1 of the Patent Document 1, as shown in FIG. 8, has a high pressure discharge lamp 2, an auxiliary lamp 3 separated from the high pressure discharge lamp 2, and a power feeding device 4. The high pressure discharge lamp 2 has an arc tube 5 and a feeder 6. The arc tube 5 has a light-emitting part 5*a* that has an inner space where mercury or the like, or luminescent material M1, is enclosed and a sealing portion 5*b* enclosing the inner space of the light-emitting part 5*a*. The feeder 6 has a pair of main electrodes 6*a*, a pair of metal foil 6*b*, and a pair of external lead bar 6*c*. Each main electrode 6*a* is provided to face each other within the light-emitting part 5*a* at a specified position. Each of the metal foils 6*b* is connected electrically to the corresponding main electrode 6*a* and buried in the sealing portion 5*b*. One end of each external lead bar 6*c* is connected electrically to the corresponding metal foil 6*b* and buried in the sealing portion 5*b*, and the other end of each external lead bar 6*c* protrudes outside.

The auxiliary lamp 3 has a discharge envelope 7, an inner electrode 8, and an outer electrode 9. The discharge envelope 7 has a discharge space enclosing medium for discharge M2 as a material that generates ultra violet UV by being excited with electrical discharge. And the discharge envelope 7 is provided toward an end face of the sealing portion 5*b*. The inner electrode 8 is provided inside the discharge space and connected electrically to one external lead bar 6*c*. One end of the outer electrode 9 is wound around an outer surface of the discharge envelope 7, and the other end of the outer electrode 9 is connected electrically to the other external lead bar 6*c*.

In this light source 1, high-frequency voltage is applied between the inner electrode 8 and the outer electrode 9 of the auxiliary lamp. And electrical discharge is generated between the inner electrode 8 and the outer electrode 9 through the discharge space of the discharge envelope 7. The medium for discharge M2 in the discharge space excited with the electrical discharge generates ultra violet rays UV. When the ultra violet rays UV irradiates the main electrodes 6*a* in the light-emitting part 5*a* of the high pressure discharge lamp 2, the electrical discharge between the main electrodes 6*a* is accelerated. Consequently, the high pressure discharge lamp 2 can be lighted with lower applying voltage.

BRIEF SUMMARY OF THE INVENTION

As just described, according to the light source disclosed in the Patent Document 1, the high pressure discharge lamp 2 can be lighted with the low applied voltage. But the lower the required lighting-up voltage is, the lower the possibility of the problems as described above is. And the light source 1 can be compacted by reducing the capacity of the power feeding device 4. Consequently, the high pressure discharge lamp with auxiliary lamp that can be lighted with further lower applied voltage was required.

The present invention has been made to clear the above problems associated with the conventional arts. It is, therefore, a main objective of the present invention to provide a high pressure discharge lamp with auxiliary lamp that can be lighted with further lower applied voltage.

To accomplish the objective, in accordance with an aspect of the present invention, a high pressure discharge lamp with auxiliary lamp 10 is configured as shown in FIG. 1.

The high pressure discharge lamp with auxiliary lamp 10 comprises:

a high pressure discharge lamp 12 having an arc tube 18 including a light-emitting part 26 with an inner space 24 enclosing a luminescent material M1 and at least one sealing portion 28*a*, 28*b* protruding from the light-emitting part 26, a pair of main electrodes 20*a*, 20*b* arranged in the inner space 24 so as to face each other, and a pair of feeders 22*a*, 22*b* supplying power to the main electrodes 20*a*, 20*b*;

an auxiliary lamp 14 having an airtight case 34 including an inner space 40 enclosing a medium for discharge M2, an inner electrode 36 with one end arranged in the inner space 40 and the other end connected to one feeder 22*a*, and an outer electrode 38 with one end attached on an outer surface of the airtight case 34 and the other end connected to the other feeder 22*b*, wherein the inner electrode 36 has a wide shape and is arranged at a position so as to part the inner space 40 to large and small spaces 40*a*, 40*b*, the outer electrode 38 is arranged at a position so as to face the large space 40*a* that is parted with the inner electrode 36, the auxiliary lamp 14 is arranged as the large space 40*a* faces the sealing portion 28*a*. The feeders 22*a*, 22*b* have reed-shaped metal foils 30*a*, 30*b* buried in the sealing portions 28*a*, 28*b* and having one ends fixed to the main electrodes 20*a*, 20*b*, and external leads 32*a*, 32*b* extending outward from the sealing portion 28*a*, 28*b*. An arrangement angle θ2 of the metal foil 30*a* buried in the sealing portion 28*a* facing the large space 40*a* of the auxiliary lamp 14 is set so as not to arrange the auxiliary lamp 14 in the face of the metal foil 30*a*.

In the auxiliary lamp 14, discharge intensity between the outer electrode 38 arranged at the position so as to face the large space 40*a* and the inner electrode 36 is larger than discharge intensity generated at the small space 40*b*. Consequently, a large amount of ultraviolet rays is generated from the large space 40*a*.

The large amount of ultraviolet rays UV is guided efficiently into the sealing portion 28*a* by arranging the large space 40*a* of the auxiliary lamp 14 so as to face the sealing portion 28*a* of the high pressure discharge lamp 12. The guided ultraviolet rays UV enter into the light-emitting part 26 and irradiate the main electrodes 20*a*, 20*b* arranged inside the light-emitting part 26. Consequently, electrons are emitted easily from the main electrodes 20*a*, 20*b* (photoelectric effect). And when the luminescent material M1 being enclosed inside the light-emitting part 26 is irradiated with the ultraviolet rays UV, the luminescent material M1 ionizes and a "discharging route" for generating the electric discharge between the main electrodes 20*a*, 20*b* is formed. Consequently, the high pressure discharge lamp 12 can be lighted instantaneously at cold start and at hot start using low applied voltage (for example, 1.2 kV).

In addition, when the arrangement angle θ2 of the reed-shaped metal foil 30*a* buried in the sealing portion 28*a* is set so as not to arrange the auxiliary lamp 14 in the face of the metal foil 30*a*, the ultraviolet rays UV are difficult to hit and be blocked by the metal foil 30*a*. The ultraviolet rays UV from the auxiliary lamp 14 are guided into the sealing portion 28*a* and proceed into the light-emitting part 26 after being reflected within the sealing portion 28*a* several times. Consequently, the ultraviolet rays UV from the auxiliary lamp 14 are affected to the main electrodes 20*a*, 20*b* effectively. The high pressure discharge lamp 12 can be lighted surely at cold start and at hot start using low applied voltage.

It is preferable to add following element to the high pressure discharge lamp with auxiliary lamp 10.

The high pressure discharge lamp with auxiliary lamp 10 further comprises a reflector 44 covering the auxiliary lamp 14. The reflector 44 has a light reflecting surface 46 facing the auxiliary lamp 14. The light reflecting surface 46 reflects ultraviolet rays UV missing the sealing portion 28*a* from the auxiliary lamp 14 towards the sealing portion 28*a*.

According to this embodiment, the amount of the ultraviolet rays UV guided into the sealing portion 28*a* can be increased. Consequently, the pressure discharge lamp 12 can be lighted with lower applied voltage surely.

And feeder wire 48 from the power feeder device may be connected to one end of the outer electrode 38.

According to this embodiment, the feeder wire 48 can be used as the outer electrode 38. Then, the number of components of the high pressure discharge lamp with auxiliary lamp 10 can be reduced.

The auxiliary lamp 14 may be contacted to the sealing portion 28*a*.

According to this embodiment, overall radiating surface area of the high pressure discharge lamp with auxiliary lamp 10 can be increased because a part of the heat generated in the sealing portion 28*a* of the high pressure discharge limp 12 while lighting is conducted easily, to the auxiliary lamp 14. Then, the possibility for damage of the sealing portion 28*a* by the heat can be reduced, and it gives the high pressure discharge lamp 12 a longer life.

And fine concavities and convexities may be formed on the inner electrode 36 of the auxiliary lamp 14.

Forming the fine concavities and convexities on a surface of the inner electrode 36 causes "field amplification" at the convexities. The "field amplification" causes the discharge between the inner electrode 36 and the outer electrode 38 with further lower voltage. Then, the high pressure discharge lamp 12 can be lighted surely.

According to the present invention, the high pressure discharge lamp with auxiliary lamp that can be lighted with lower applied voltage can be provided.

BRIEF DESCRIPTION OF THE DRAWING

FIG. 1(*a*) is an end elevational view taken on line A-A.

FIG. 3(*a*-2) is an end elevational view taken on line B-B of FIG. 3(*a*-1). And FIG. 3(*b*-2) is an end elevational view taken on line C-C of FIG. 3(*b*-1).

DETAILED DESCRIPTION

Figure 1:
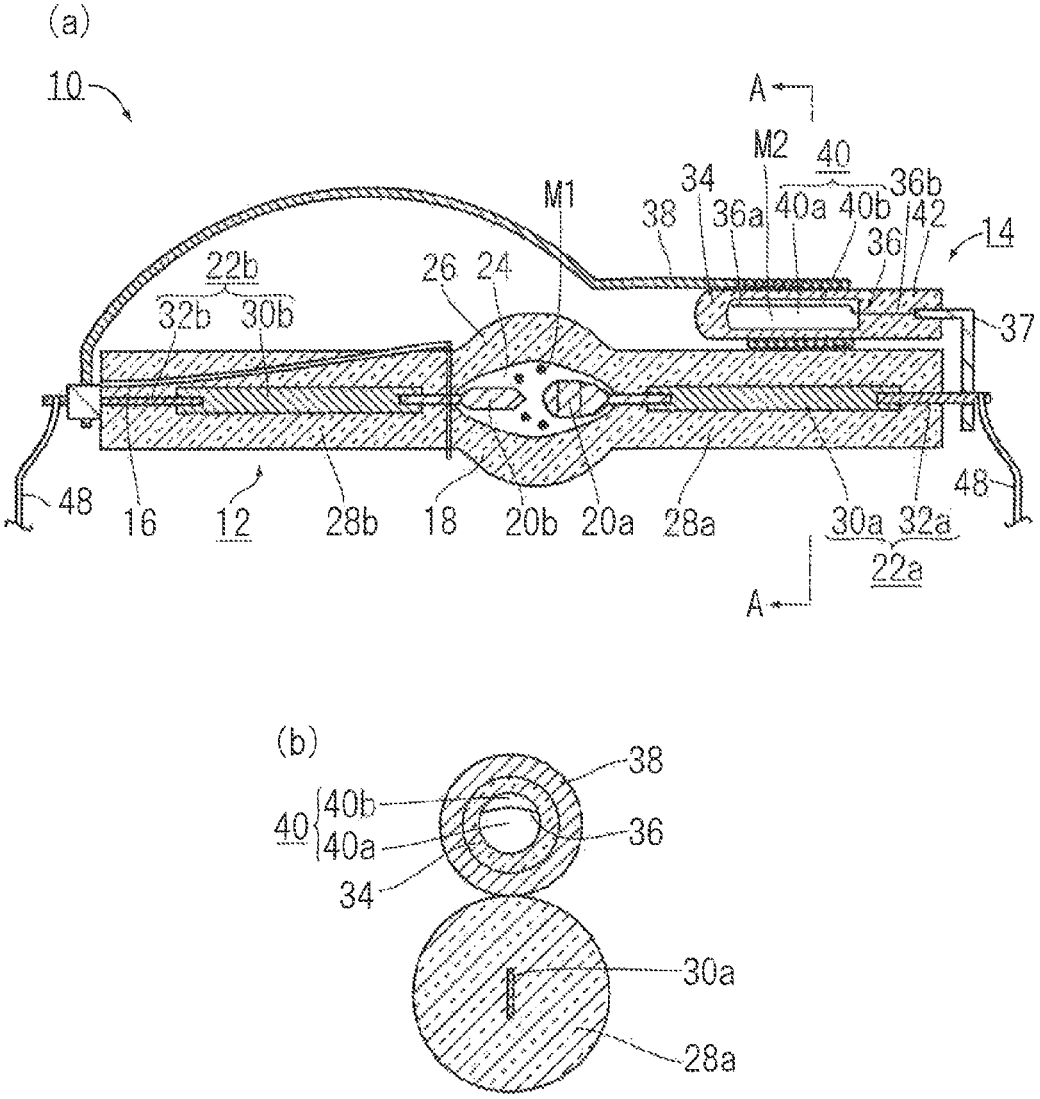
FIG. 1(*a*) is a longitudinal cross section showing the high pressure discharge lamp with auxiliary lamp of the present invention.

Embodiments of the high pressure discharge lamp with auxiliary lamp 10 in the present invention are explained by using figures as below. As shown in FIG. 1, a high pressure discharge lamp with auxiliary lamp 10 of this embodiment comprises: a high pressure discharge lamp 12; an auxiliary lamp 14; and a trigger wire 16.

The high pressure discharge lamp 12 has an arc tube 18, a pair of main electrodes 20*a*, 20*b*, and a pair of feeders 22*a*, 22*b*.

The arc tube 18 is made of quartz glass and has a light-emitting part 26 including an inner space 24 enclosing luminescent material M1 such as mercury or the like, and a pair of sealing portions 28*a*, 28*b* protruding from both sides of the light-emitting part 26 for sealing the inner space 24 of the light-emitting part 26. In addition, in this embodiment, the high pressure discharge lamp 12 has two sealing portions 28*a*, 28*b*. The high pressure discharge lamp having one sealing portion, as pointed out above, may be used.

The main electrodes 20*a*, 20*b* are made of tungsten and arranged in the inner space 24 of the light-emitting part 26 in a state that the main electrodes 20*a*, 20*b* face each other. In this embodiment, the high pressure discharge lamp 12 being lighted with DC (direct-current), the electrode 20*a* for anode is larger than the electrode 20*b* for cathode. In the high pressure discharge lamp 12 being lighted with AC [alternating-current], both main electrodes 20*a*, 20*b* have the same size.

Each feeder 22*a*, 22*b* has a molybdenum reed-shaped metal foil 30*a*, 30*b* and an external lead 32*a*, 32*b* for supplying power to the metal foil 30*a*, 30*b*.

The auxiliary lamp 14 has an airtight case 34, an inner electrode 36, an external lead for inner electrode 37, and an outer electrode 38. And the auxiliary lamp 14 is arranged so as to contact one sealing portion 28*a* of the high pressure discharge lamp 12.

The airtight case 34 is a cylindrical quartz glass and has hemispherical one end including an inner space 40 enclosing medium for discharge M2 and the other end including an auxiliary lamp sealing portion 42 sealing the inner space 40. In this embodiment, the medium for discharge M2 is argon or the liker, or rare gas.

The inner electrode 36 is a molybdenum reed-shaped and wide member. One end 36*a* of the inner electrode 36 is arranged in the inner space 40 along a longer direction of the airtight case 34. The other end 36*b* of the inner electrode 36 is buried in the auxiliary lamp sealing portion 42. In addition, the shape of the inner electrode 36 is not limited to the reed-shape as long as the inner electrode 36 has a wide shape.

The inner electrode 36 is arranged so as to part the inner space 40 along the longer direction of the airtight case 39 into a large space 40*a* and a small space 40*b*. The auxiliary lamp 14 is so arranged that the large space 90*a* faces one sealing portion 28*a*.

Figure 2:
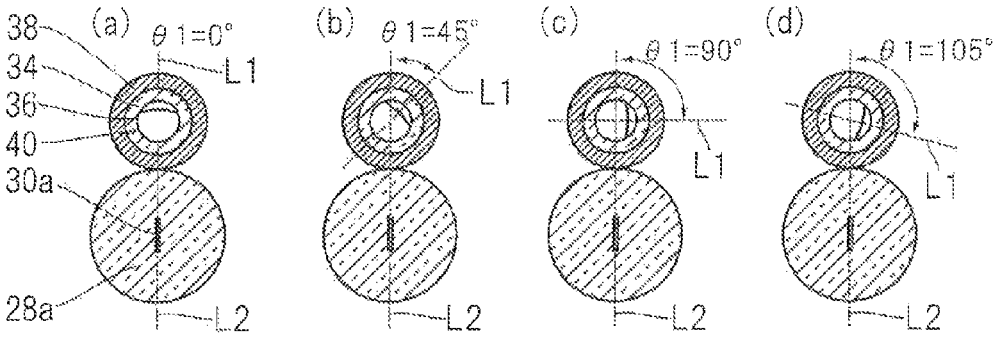
FIG. 2 is an end elevational view showing an angle of a large space of the auxiliary lamp to a sealing portion of (a) 0 degrees, (b) 45 degrees, (c) 90 degrees, and (d) 105 degrees.

"Faces one sealing portion 28*a*" means, as shown in FIG. 2, in an elevational view, that an angle θ1 formed by a straight line L1 connecting the center of the inner electrode 36 with the center of the inner space 40 and another straight line L2 connecting the center of the inner space 90 with the center of the sealing portion 28*a* is 0 degrees to not more than 105 degrees. The angle θ1 is not only clockwise but counterclockwise. The reason that this range of the angle is preferable is described below.

Furthermore, "to part the inner space 40" means, as shown in figure, not only a case that both ends of the inner electrode 36 on a cross-section surface contact a periphery, or inner wall of the airtight case 34, of the inner space 40 and the inner space 40 is separated totally but a case that both ends of the inner electrode 36 apart from the periphery of the inner space 40 and gaps exist between both ends and the periphery.

One end of the external load for inner electrode 37, as shown in FIG. 1, is connected to the other end 36*b* of the inner electrode 36 in the auxiliary lamp sealing portion 42. The other end of the external load for inner electrode 37 is connected to one external load 32*a* protruding from one sealing portion 28*a*.

One end part of the outer electrode 38 is wound around the periphery surface, where faces the inner space 40, of the airtight case 34. And the other end of the outer electrode 38 is connected to the other external lead 32*b* protruding form the other sealing portion 28*b* of the high pressure discharge lamp 12.

In addition, for emitting the ultraviolet rays UV from the inner space 40 of the airtight case 34 outward, it is preferable to keep gaps between the wound outer electrodes 38. But the ultraviolet rays UV can be emitted outside through the end of the airtight case 34. The effect of the auxiliary lamp 14, therefore, is not denied even if the outer electrode 38 is wound without the gaps.

Figure 3:
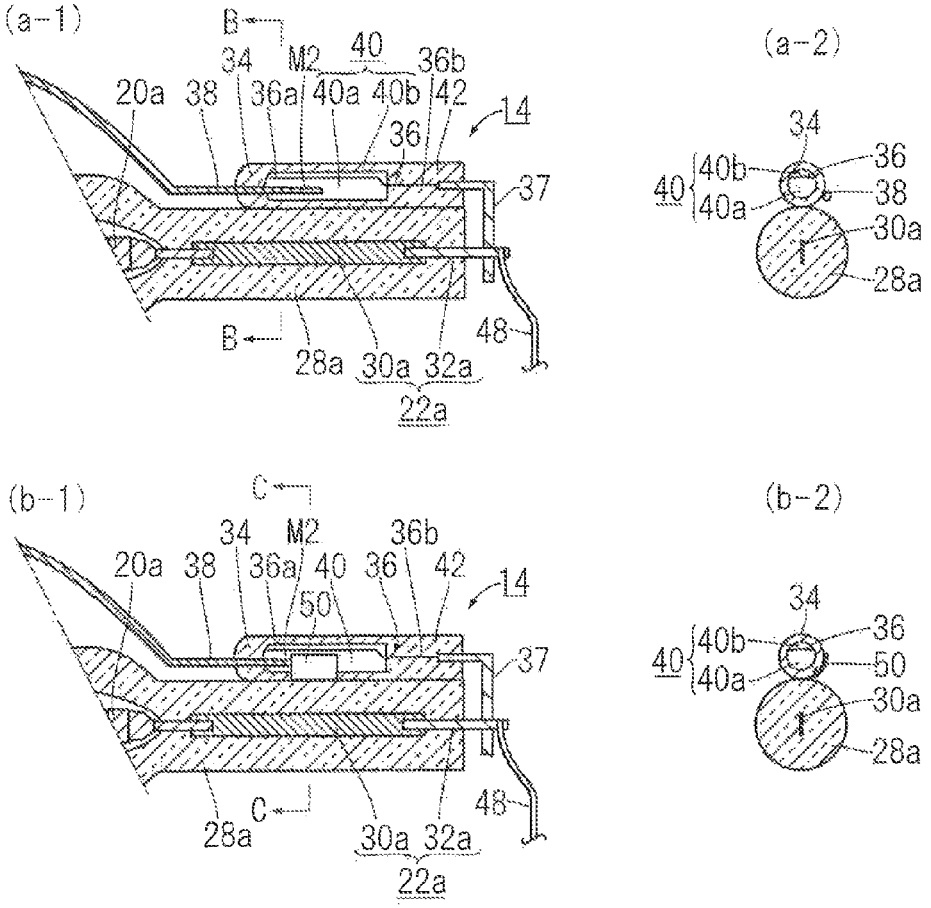
FIG. 3 is an illustration diagram for another embodiment relating to an outer electrode of an auxiliary lamp.

It is enough to arrange the outer electrode 38 so as to engage on the large space 40*a* parted by the inner electrode 36. Consequently, the outer electrode 38 may not be wound around as described above. As shown in FIG. 3(*a*), one end of the outer electrode 38 may be arranged along the periphery surface, where faces the large space 40*a*, of the airtight case 34. And as shown in FIG. 3(*b*), a metal foil 50 may be arranged along the periphery surface, where faces the large space 40*a*, of the airtight case 34 and the metal foil 50 may be connected to one end of the outer electrode 38. The outer electrode 38 may be attached to the airtight case 34 by another ways.

The trigger wire 16 is a metal wire having conductivity. One end of the trigger wire 16 is wound around a boundary between the other sealing portion 28*b* and the light-emitting part 26, and the other end of the trigger wire 16 is connected to the other external lead 32*b*. The trigger wire 16 may also be wound around the other boundary between one sealing portion 28*a* and the light-emitting part 26 in addition to winding the trigger wire 16 to the boundary between the one sealing portion 28*a* and the light-emitting part 26.

A procedure for assembling the high pressure discharge lamp with auxiliary lamp 10 in this embodiment is explained as below. The high pressure discharge lamp 12 and the auxiliary lamp 14 produced by a conventional method are prepared. The outer electrode 38 is not wound around the auxiliary lamp 14 in this step. Then, one end part of the outer electrode 38 is wound around the periphery surface of the airtight case 34 of the auxiliary lamp 14 and the auxiliary lamp 14 is arranged so as to contact the periphery surface of one sealing portion 28*a*. To be precise, the outer electrode 38 wound around the airtight case 34 contacts the periphery surface of the sealing portion 28*a*. The other end of the outer electrode 38 is connected to the other external lead 32*b* of the high pressure discharge lamp 12 and the external lead for inner electrode 37 is connected to one external lead 32*a*. At the end, one end of the trigger wire 16 is wound around the boundary between the other sealing portion 28*b* and the light-emitting part 26. And the other end of the trigger wire is connected to the other external lead 32*b*. The procedure of winding the outer electrode 38 around the airtight case 34, arrangement of the outer electrode 38 and the external lead for inner electrode 37 to the external lead 32*a*, 32*b*, and wind and connection of the trigger wire 16 are not limited to the procedure described above.

Figure 4:
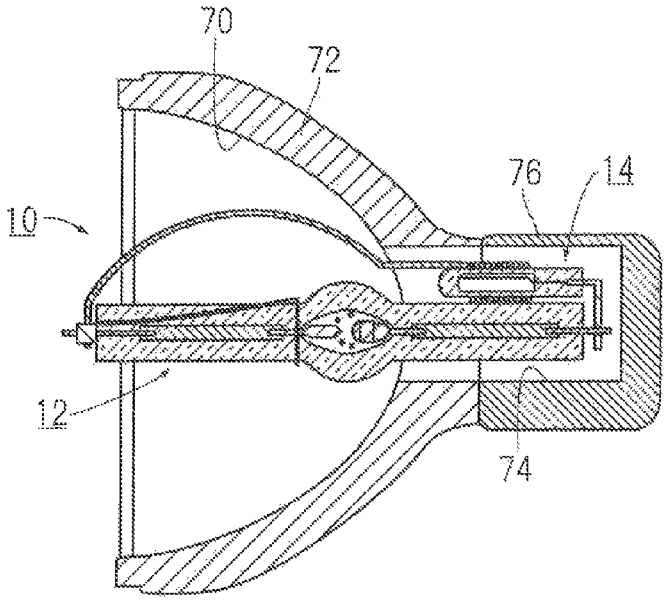
FIG. 4 is an end elevational view showing a high pressure discharge lamp with auxiliary lamp being attached to a reflector.

In general, as shown in FIG. 4, the completed high pressure discharge lamp with auxiliary lamp 10 is attached to a bowl-shaped reflecting mirror 72 having a light reflecting surface 70 on an inner surface. On a bottom of the reflecting mirror 72, a neck part 76 having a lamp accommodating hole 74 which accommodates the auxiliary lamp 14 and the sealing portion 28*a* to which the auxiliary lamp 14 is attached is provided. In a state that the auxiliary lamp 14 and the sealing portion 28*a* are accommodated, adhesives or the like (not shown) having high heat conductivity fixes the high pressure discharge lamp with auxiliary lamp 10 to the reflecting mirror 72. And the auxiliary lamp 14 may be attached on an opening side of the reflecting mirror 72, or the other sealing portion 28*b* of the high pressure discharge lamp 12. In this case, the auxiliary lamp 14 is positioned in the proximity of "well-ventilated" opening of the reflecting mirror 72. Consequently, the heat radiation capacity becomes higher than the case that the auxiliary lamp 14 is attached on the neck part 76 of the reflecting mirror 72. The possibility of heat damage for the sealing portion 28*a* of the high pressure discharge lamp 12 can be lower.

When the high pressure discharge lamp 12 is lighted, the both feeder wires 48 extending from a power supply (now shown) are connected to the both external leads 32*a*, 32*b* of the high pressure discharge lamp 12, and high voltage from the power supply is applied between the both external leads 32*a*, 32*b*. The insulation breakdown is generated between the inner electrode 36 and the outer electrode 38 of the auxiliary lamp 14, with discharge. The medium for discharge M2 in the inner space 40 being excited by the discharge emits ultraviolet rays UV. The emitted ultraviolet rays UV entering into the inner space 24 through inside of one sealing portion 28*a* irradiate the main electrodes 20*a*, 20*b*. The irradiated main electrodes 20*a*, 20*b* emit electrons easily (photoelectric effect). The luminescent material M1 enclosed in the inner space 24 of the light-emitting part 26 is ionized by receiving the ultraviolet UV, with formation of a "discharging route" for discharge between both main electrodes 20*a*, 20*b*. Consequently, the high pressure discharge lamp 12 can be lighted instantaneously in a cold start or a hot start with low voltage, for example 1.2 kV.

In the auxiliary lamp 14 of this embodiment, the inner space 40 of the airtight case 34 is parted into a large space 40*a* and a small space 40*b* with the inner electrode 36. Discharge intensity between the outer electrode 38 arranged at the position so as to face the large space 40*a* and the inner electrode 36 is larger than discharge intensity generated at the small space 40*b*. Consequently, a large amount of ultra violet rays UV is generated from the large space 40*a*.

Because the auxiliary lamp 14 is arranged at the position where the large space 40*a* faces one sealing portion 28*a*, a large amount of the ultraviolet rays UV from the large space 40*a* irradiate the main electrodes 20*a*, 20*b* through the sealing portion 28*a*. Consequently, the high pressure discharge lamp 12 can be lighted steadily with lower voltage than a voltage lighting conventional lamps.

The auxiliary lamp 14 contacts the sealing portion 28*a*. Consequently, overall radiating surface area of the high pressure discharge lamp with auxiliary lamp 10 can be increased because a part of the heat generated in the sealing portion 28*a* of the high pressure discharge lamp 12 while lighting is conducted easily to the auxiliary lamp 14. Then, the possibility for damage of the sealing portion 28*a* by the heat can be reduced, and it gives the high pressure discharge lamp 12 a longer life.

Figure 5:
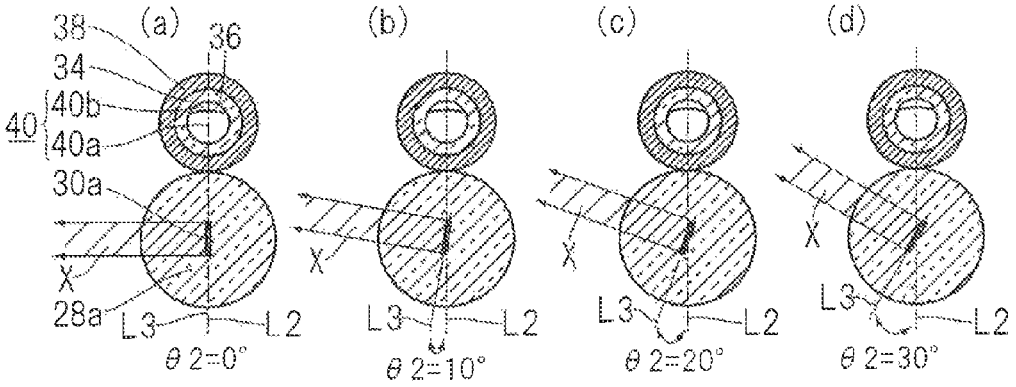
FIG. 5 is a cross sectional view showing an angle of a metal foil buried in a sealing portion facing an auxiliary lamp of (a) 0 degrees, (b) 10 degrees, (c) 20 degrees, and (d) 30 degrees.

It is preferable that an arrangement angle of the metal foil 30*a* buried in the sealing portion 28*a* facing the large space 40*a* of the auxiliary lamp 14 is set so as not to arrange the auxiliary lamp 14 in the face of the metal foil 30*a*, as shown in FIG. 5. In particular, an angle θ2 formed by a straight line L2 connecting the center of the inner space 40 with the center of the sealing portion 28*a* and a straight line L3 paralleled to a width direction of the metal foil 30*a* is set to 0 degrees to 30 degrees in sectional view. The reason that this range of the angle is preferable is described below.

When the ultraviolet rays UV from the auxiliary lamp 19 are guided into the sealing portion 28*a* and proceed into the light-emitting part 26 after being reflected within the sealing portion 28*a* several times, the ultraviolet rays UV are difficult to hit and be blocked by the metal foil 30*a*. Consequently, the ultraviolet rays UV from the auxiliary lamp 14 are affected to the main electrodes 20*a*, 20*b* effectively. The high pressure discharge lamp 12 can be lighted surely at cold start and hot start with lower applied voltage.

Figure 6:
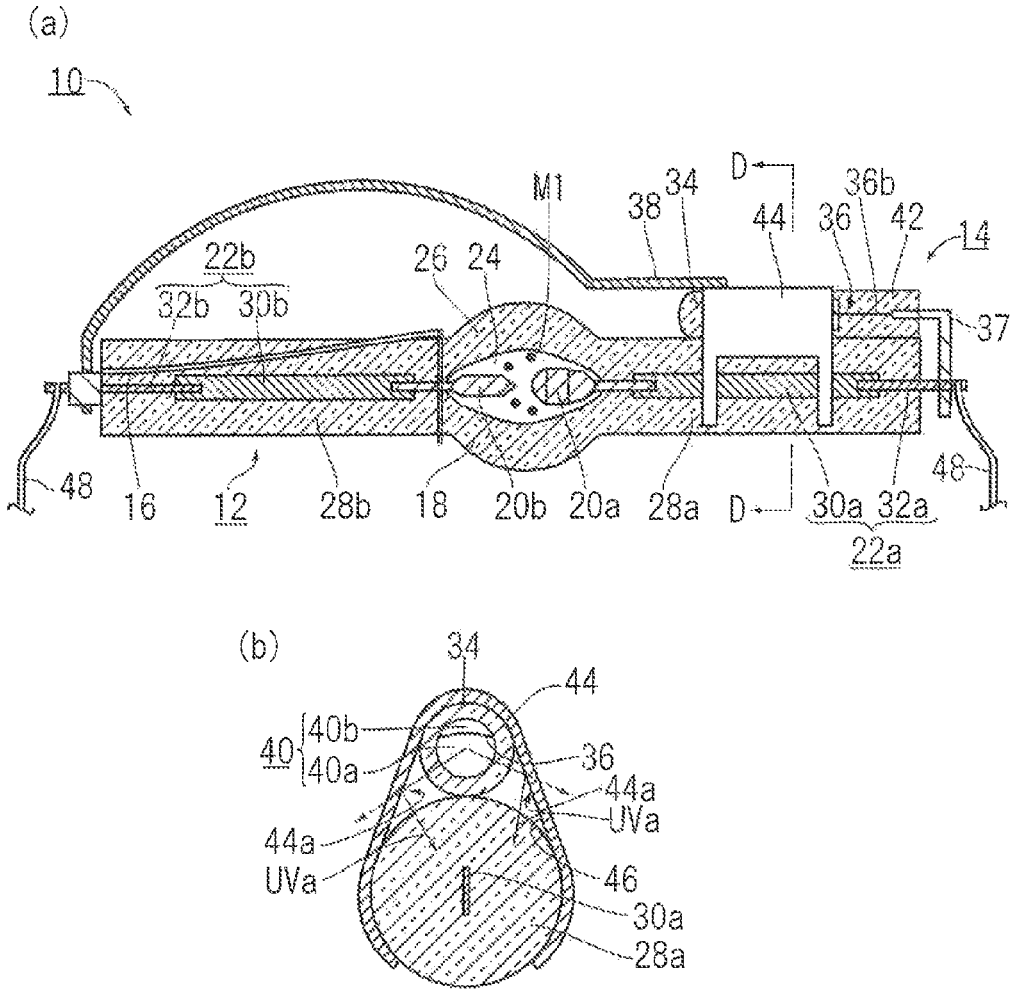
FIG. 6(*a*) is a longitudinal cross sectional view showing a reflector being attached, and FIG. 6(*b*) is an end elevational view taken on line D-D.

As shown in FIG. 6, the high pressure discharge lamp with auxiliary lamp 10 may include a reflector 44 covering the auxiliary lamp 14. In this embodiment disclosed in the figure, one end part of the outer electrode 38 is not wound around the periphery surface of the airtight case 34. The auxiliary lamp 14 is covered by a conductive metal reflector 44, and one end of the outer electrode 38 is connected to this reflector 44. Consequently, the reflector is also used as the outer electrode 38. In this case, the reflector 44, or the outer electrode 38, is separated from the outer surface of the airtight case 34 on the large space 90*a* side. In this state, a part 44*a* separated from the outer surface of the reflector 44 faces the large space 40*a*. Discharge is generated between this part 44*a* and the inner electrode 36, or in the large space 40*a*. One end part of the outer electrode 38 may be wound around the periphery surface of the airtight case 34. After that, the reflector 44 may be placed so as to cover them.

A light reflecting surface 46 facing the auxiliary lamp 14 is formed on an inner surface of the reflector 44. This light reflecting surface 46 reflects ultraviolet rays UVa missing the sealing portion 28*a* from the auxiliary lamp 14 to the sealing portion 28*a*.

According to this embodiment, an amount of the ultraviolet rays UV guided into the sealing portion 28*a* can be increased. Consequently, the high pressure discharge lamp 12 can be lighted surely with low voltage.

Figure 7:
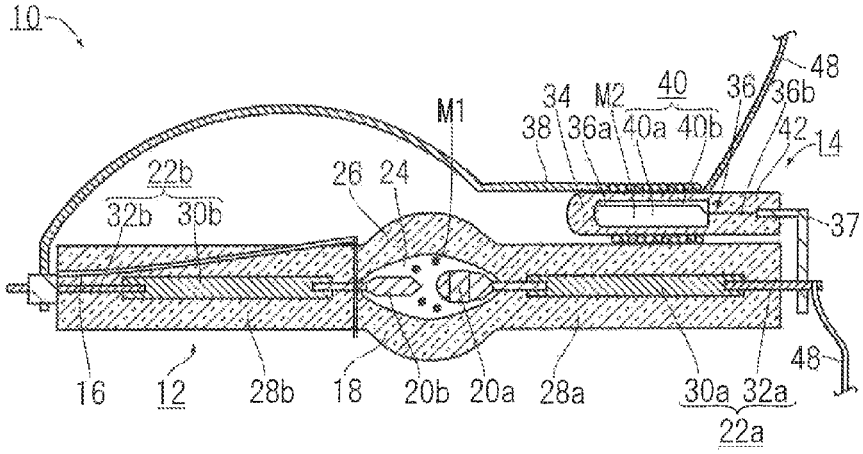
FIG. 7 is a cross section showing one end of an outer electrode is connected to a feeder wire from a power supply.
Figure 8:
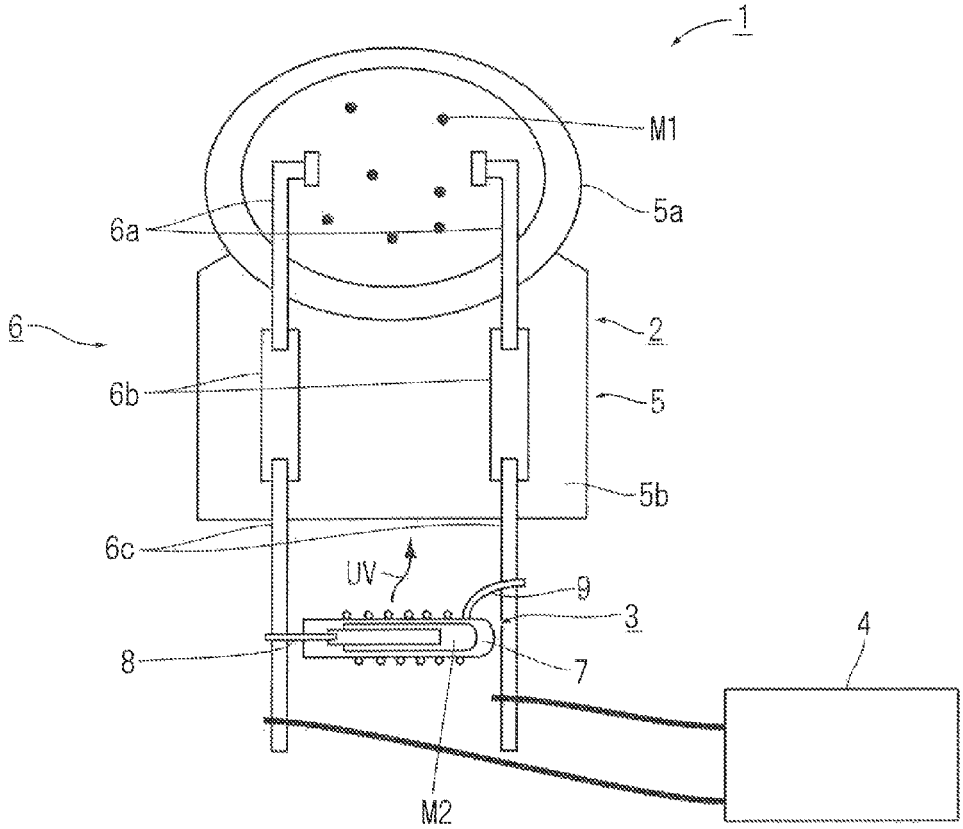
FIG. 8 shows a conventional technology.

Furthermore, as shown in FIG. 7, the feeder wire 48 feeding the other external lead 32*b* of the high pressure discharge lamp 12 may be connected to one end of the outer electrode 38. According to this embodiment, the feeder wire 48 can be used as the outer electrode 38. Then, the number of components of the high pressure discharge lamp with auxiliary lamp 10 can be reduced.

And fine concavities and convexities may be formed on a surface of the inner electrode 36 of the auxiliary lamp 19. Forming the fine concavities and convexities on a surface of the inner electrode 36 causes the "field amplification" at the convexities. The "field amplification" causes the discharge between the inner electrode 36 and the outer electrode 38 with further lower voltage. Then, the high pressure discharge lamp 12 can be lighted surely. The fine concavities and convexities are formed by electrolytic etching with nitric acid aqueous solution. The method for forming the fine concavities and convexities is not limited to the electrolytic etching.

Table 1 shows preferred range of the angle θ1 formed by the straight line L1 connecting the center of the inner electrode 36 with the center of the inner space 40 and the straight line L2 connecting the center of the inner space 40 with the center of the sealing portion 28*a*. Sample lamps having the angle θ1 of 0 degrees, 45 degrees, 90 degrees, and 105 degrees were prepared, and five sample lamps were prepared for each angle θ1. High voltage of 1.0 kV, 1.2 kV, 1.4 kV, 1.6 kV, and 1.8 kV were applied to each sample lamp for lighting-up. The angle θ2 formed by the straight line L2 connecting the center of the inner space 40 with the center of the sealing portion 28*a* and the straight line L3 paralleled to a width direction of the metal foil 30*a* was set to 0 degrees.

TABLE 1

| | Sample | Applying voltage (kV) | | | | |
|---|---|---|---|---|---|---|
| Angle θ1 | lamp number | 1.0 | 1.2 | 1.4 | 1.6 | 1.8 |
| 0° | 1 | Missed | Lighted | Lighted | Lighted | Lighted |
| | 2 | Missed | Lighted | Lighted | Lighted | Lighted |
| | 3 | Missed | Lighted | Lighted | Lighted | Lighted |
| | 4 | Missed | Lighted | Lighted | Lighted | Lighted |
| | 5 | Missed | Missed | Lighted | Lighted | Lighted |
| 45° | 1 | Missed | Lighted | Lighted | Lighted | Lighted |
| | 2 | Missed | Lighted | Lighted | Lighted | Lighted |
| | 3 | Missed | Lighted | Lighted | Lighted | Lighted |

TABLE 1-continued

| Angle θ1 | Sample lamp number | Applying voltage (kV) 1.0 | 1.2 | 1.4 | 1.6 | 1.8 |
|---|---|---|---|---|---|---|
| | 4 | Missed | Missed | Lighted | Lighted | Lighted |
| | 5 | Missed | Missed | Lighted | Lighted | Lighted |
| 90° | 1 | Missed | Lighted | Lighted | Lighted | Lighted |
| | 2 | Missed | Lighted | Lighted | Lighted | Lighted |
| | 3 | Missed | Missed | Lighted | Lighted | Lighted |
| | 4 | Missed | Missed | Lighted | Lighted | Lighted |
| | 5 | Missed | Missed | Lighted | Lighted | Lighted |
| 105° | 1 | Missed | Lighted | Lighted | Lighted | Lighted |
| | 2 | Missed | Lighted | Lighted | Lighted | Lighted |
| | 3 | Missed | Missed | Lighted | Lighted | Lighted |
| | 4 | Missed | Missed | Lighted | Lighted | Lighted |
| | 5 | Missed | Missed | Lighted | Lighted | Lighted |
| 120° | 1 | Missed | Lighted | Lighted | Lighted | Lighted |
| | 2 | Missed | Missed | Lighted | Lighted | Lighted |
| | 3 | Missed | Missed | Missed | Lighted | Lighted |
| | 4 | Missed | Missed | Missed | Lighted | Lighted |
| | 5 | Missed | Missed | Missed | Missed | Lighted |

As shown in the table 1, some sample lamps of each angle θ1 were not lighted when the high voltage was 1.0 kV or 1.2 kV. But when the high voltage was not lower than 1.4 kV, all sample lamps of the angle θ1 of 0 degrees to 105 degrees were lighted without problems. This shows that the angle θ1 of 0 degrees to 105 degrees is preferable.

Table 2 shows preferred range of the angle θ2 formed by the straight line L2 connecting the center of the inner space 40 with the center of the sealing portion 28*a* and the straight line L3 paralleled to a width direction of the metal foil 30*a*. Sample lamps having the angle of θ2 of 0 degrees, 10 degrees, 20 degrees, 30 degrees, and 40 degrees were prepared, and five sample lamps were prepared for each angle θ2. High voltage of 1.0 kV, 1.2 kV, 1.4 kV, 1.6 kV, and 1.8 kV were applied to each sample lamp for lighting-up. The angle θ1 formed by the straight line L1 connecting the center of the inner electrode 36 with the center of the inner space 40 and the straight line L2 connecting the center of the inner space 40 with the center of the sealing portion 28*a* was set to 0 degrees.

TABLE 2

| Angle θ2 | Sample lamp number | Applying voltage (kV) 1.0 | 1.2 | 1.4 | 1.6 | 1.8 |
|---|---|---|---|---|---|---|
| 0° | 1 | Missed | Lighted | Lighted | Lighted | Lighted |
| | 2 | Missed | Lighted | Lighted | Lighted | Lighted |
| | 3 | Missed | Lighted | Lighted | Lighted | Lighted |
| | 4 | Missed | Lighted | Lighted | Lighted | Lighted |
| | 5 | Missed | Missed | Lighted | Lighted | Lighted |
| 10° | 1 | Missed | Lighted | Lighted | Lighted | Lighted |
| | 2 | Missed | Lighted | Lighted | Lighted | Lighted |
| | 3 | Missed | Lighted | Lighted | Lighted | Lighted |
| | 4 | Missed | Missed | Lighted | Lighted | Lighted |
| | 5 | Missed | Missed | Lighted | Lighted | Lighted |
| 20° | 1 | Missed | Lighted | Lighted | Lighted | Lighted |
| | 2 | Missed | Lighted | Lighted | Lighted | Lighted |
| | 3 | Missed | Lighted | Lighted | Lighted | Lighted |
| | 4 | Missed | Missed | Lighted | Lighted | Lighted |
| | 5 | Missed | Missed | Lighted | Lighted | Lighted |
| 30° | 1 | Missed | Lighted | Lighted | Lighted | Lighted |
| | 2 | Missed | Missed | Lighted | Lighted | Lighted |
| | 3 | Missed | Missed | Lighted | Lighted | Lighted |
| | 4 | Missed | Missed | Lighted | Lighted | Lighted |
| | 5 | Missed | Missed | Lighted | Lighted | Lighted |
| 40° | 1 | Missed | Lighted | Lighted | Lighted | Lighted |
| | 2 | Missed | Missed | Lighted | Lighted | Lighted |
| | 3 | Missed | Missed | Lighted | Lighted | Lighted |
| | 4 | Missed | Missed | Missed | Missed | Lighted |
| | 5 | Missed | Missed | Missed | Missed | Lighted |

As shown in the table 2, some sample lamps of each angle θ2 were not lighted when the high voltage was 1.0 kV or 1.2 kV. But when the high voltage was not lower than 1.4 kV, all sample lamps of the angle θ2 of 0 degrees to 30 degrees were lighted without problems. This shows that the angle θ2 of 0 degrees to 30 degrees is preferable.

Table 3 shows differences of starting ability between with and without the reflector 44. The angle θ1 formed by the straight line L1 connecting the center of the inner electrode 36 with the center of the inner space 40 and the straight line L2 connecting the center of the inner space 40 with the center of the sealing portion 28*a* was set to 0 degrees, and the angle θ2 formed by the straight line L2 connecting the center of the inner space 40 with the center of the sealing portion 28*a* and the straight line L3 paralleled to a width direction of the metal foil 30*a* was set to 0 degrees.

TABLE 3

| | Sample lamp number | Applying voltage (kV) 1.0 | 1.2 | 1.4 | 1.6 | 1.8 |
|---|---|---|---|---|---|---|
| Without reflector | 1 | Missed | Lighted | Lighted | Lighted | Lighted |
| | 2 | Missed | Lighted | Lighted | Lighted | Lighted |
| | 3 | Missed | Lighted | Lighted | Lighted | Lighted |
| | 4 | Missed | Lighted | Lighted | Lighted | Lighted |
| | 5 | Missed | Missed | Lighted | Lighted | Lighted |
| With reflector | 1 | Lighted | Lighted | Lighted | Lighted | Lighted |
| | 2 | Missed | Lighted | Lighted | Lighted | Lighted |
| | 3 | Missed | Lighted | Lighted | Lighted | Lighted |
| | 4 | Missed | Lighted | Lighted | Lighted | Lighted |
| | 5 | Missed | Lighted | Lighted | Lighted | Lighted |

As shown in the table 3, when the reflector 44 was not provided, five sample lamps were lighted only with the high voltage of 1.4 kV. But when the reflector 44 was provided, five sample lamps were lighted with the high voltage of not less than 1.2 kV.

Furthermore, table 4 shows differences of lighting-up ability between with and without the fine concavities and convexities on the surface of the inner electrode 36 of the auxiliary lamp 14. The angle θ1 formed by the straight line L1 connecting the center of the inner electrode 36 with the center of the inner space 40 and the straight line L2 connecting the center of the inner space 40 with the center of the sealing portion 28*a* was set to 0 degrees, and the angle θ2 formed by the straight line L2 connecting the center of the inner space 40 with the center of the sealing portion 28*a* and the straight line L3 paralleled to a width direction of the metal foil 30*a* was set to 0 degrees.

TABLE 4

| | Sample lamp number | Applying voltage (kV) 1.0 | 1.2 | 1.4 | 1.6 | 1.8 |
|---|---|---|---|---|---|---|
| Without fine concavities and convexities | 1 | Missed | Lighted | Lighted | Lighted | Lighted |
| | 2 | Missed | Lighted | Lighted | Lighted | Lighted |
| | 3 | Missed | Lighted | Lighted | Lighted | Lighted |
| | 4 | Missed | Lighted | Lighted | Lighted | Lighted |
| | 5 | Missed | Missed | Lighted | Lighted | Lighted |
| With fine concavities and convexities | 1 | Lighted | Lighted | Lighted | Lighted | Lighted |
| | 2 | Lighted | Lighted | Lighted | Lighted | Lighted |
| | 3 | Missed | Lighted | Lighted | Lighted | Lighted |
| | 4 | Missed | Lighted | Lighted | Lighted | Lighted |
| | 5 | Missed | Lighted | Lighted | Lighted | Lighted |

As shown in the table 4, when the fine concavities and convexities on the surface of the inner electrode 36 were not provided, five sample lamps were lighted only with the high voltage of 1.4 kV. But when the fine concavities and convexities were provided, five sample lamps were lighted with the high voltage of not less than 1.2 kV.

And table 5 shows how much the temperature of the sealing portion 28*a* while lighting of the high pressure discharge lamp 12 was reduced by contacting the auxiliary lamp 19 on the sealing portion 28*a*.

TABLE 5

| | Sample lamp number | Temperature of sealing portion (° C.) | Average temperature (° C.) |
|---|---|---|---|
| Auxiliary lamp aparts from sealing portion | 1 | 405 | |
| | 2 | 400 | |
| | 3 | 410 | |
| | 4 | 420 | |
| | 5 | 408 | 409 |
| Auxiliary lamp contacts on sealing portion | 1 | 360 | |
| | 2 | 355 | |
| | 3 | 350 | |
| | 4 | 349 | |
| | 5 | 362 | 355 |

As shown in the table 5, a temperature of a conventional high pressure discharge lamp with auxiliary lamp of which sealing portion was separated from an auxiliary lamp in operation was approximately 409 degrees C. In contrast, a temperature of the high pressure discharge lamp with auxiliary lamp of this embodiment of which sealing portion contacted the sealing portion 28*a* of the auxiliary lamp 14 was approximately 355 degrees C. The temperature of this embodiment was more than 50 degrees C. lower than the temperature of the conventional lamp. According to the relation known by the inventors between the temperature of the sealing portion and a lifetime of the high pressure discharge lamp 12, the lifetime will be about 2000 hours when the temperature of the sealing portion in operation is approximately 409 degrees C. In contrast, the lifetime will be about 7000 hours when the temperature of the sealing portion in operation is approximately 355 degrees C. This tells that the lifetime dramatically lengthens by reducing the temperature of the sealing portion.

Although the invention has been described in its preferred form with a certain degree of particularity, it is understood that the present disclosure of the preferred form has been changed in the details of construction and the combination and arrangement of parts may be resorted to without departing from the spirit and scope of the invention as hereinafter claimed.

The disclosure of Japanese Patent Application No. 2011-233310 filed Oct. 24, 2011 including specification, drawings and claims is incorporated herein by reference in its entirety.

What is claimed is:

1. A high pressure discharge lamp comprising:

an arc tube including a light-emitting part with an inner space enclosing a luminescent material and at least one sealing portion protruding from the light-emitting part;

a pair of main electrodes arranged in the inner space so as to face each other;

first and second feeders supplying power to the main electrodes; and an auxiliary lamp having an airtight case including an inner space enclosing a medium for discharge, an inner electrode with one end arranged in the inner space and the other end connected to the first feeder, and an outer electrode with one end attached on an outer surface of the airtight case and the other end connected to the second feeder, wherein the inner electrode has a wide shape and is arranged at a position so as to part the inner space to large and small spaces, the outer electrode is arranged at a position so as to face the large space which is parted with the inner electrode, the auxiliary lamp is arranged as the large space faces the sealing portion;

the first and second feeders have reed-shaped metal foil buried in the sealing portions and having one ends fixed to the main electrodes, and external leads extending outward from the sealing portion; and an angle between a plane associated with a surface of the metal foil buried in the sealing portion and a line defined between a first center of the inner space and a second center of the sealing portion is less than thirty degrees.

2. The high pressure discharge lamp according to claim 1, further comprising a reflector covering the auxiliary lamp, wherein the reflector has a light reflecting surface facing the auxiliary lamp, the light reflecting surface reflects ultraviolet rays missing the sealing portion from the auxiliary lamp towards the sealing portion.

3. The high pressure discharge lamp according to claim 1, wherein the feeder wire from the power feeder device is connected to one end of the outer electrode.

4. The high pressure discharge lamp according to claim 1, wherein the auxiliary lamp is contacted to the sealing portion.

5. The high pressure discharge lamp according to claim 1, wherein fine concavities and convexities are formed on the inner electrode of the auxiliary lamp.

* * * * *